US009434064B2

(12) United States Patent
Rostami

(10) Patent No.: US 9,434,064 B2
(45) Date of Patent: Sep. 6, 2016

(54) ROCKER BRUSH ASSEMBLY

(71) Applicant: Habib Rostami, Irvine, CA (US)

(72) Inventor: Habib Rostami, Irvine, CA (US)

(73) Assignee: Naturezway, Inc., City of Commerce, CA (US)

( * ) Notice: Subject to any disclaimer, the term of this patent is extended or adjusted under 35 U.S.C. 154(b) by 63 days.

(21) Appl. No.: 14/048,031

(22) Filed: Oct. 7, 2013

(65) Prior Publication Data

US 2015/0096138 A1 Apr. 9, 2015

(51) Int. Cl.

| | |
|---|---|
| ***A46B 5/02*** | (2006.01) |
| ***A46B 15/00*** | (2006.01) |
| ***B25G 1/10*** | (2006.01) |
| ***A46B 5/00*** | (2006.01) |

(52) U.S. Cl.

CPC ..... *B25G 1/10* (2013.01); *A46B 5/0095* (2013.01); *A46B 5/021* (2013.01); *A46B 15/0097* (2013.01); *A46B 5/02* (2013.01); *A46B 2200/3033* (2013.01)

(58) Field of Classification Search

CPC ..... A46B 5/02; A46B 5/021; A46B 5/0095; A46B 15/0097; F16M 11/24; B25G 1/10

See application file for complete search history.

(56) References Cited

U.S. PATENT DOCUMENTS

| | | | | |
|---|---|---|---|---|
| 524,894 | A * | 8/1894 | Forsberg | 482/85 |
| 1,051,815 | A * | 1/1913 | Morgan | 15/143.1 |
| 1,630,137 | A * | 5/1927 | Ruwwe | 446/325 |
| 1,690,311 | A * | 11/1928 | Reich | 206/362.3 |
| 1,945,010 | A * | 1/1934 | Waterbury | 416/244 R |
| 2,632,977 | A * | 3/1953 | Valasek | 446/325 |
| 3,442,045 | A * | 5/1969 | Green | 446/297 |
| 4,129,963 | A * | 12/1978 | Perry et al. | 446/325 |
| D361,894 | S | 9/1995 | Hoagland | |
| 5,956,796 | A * | 9/1999 | Lodato | 15/167.1 |
| 6,250,833 | B1 | 6/2001 | Perry et al. | |
| 6,490,760 | B1 | 12/2002 | Lauer et al. | |
| 6,698,065 | B2 * | 3/2004 | Lauer | 16/436 |
| 6,793,094 | B2 * | 9/2004 | Turnbough | 220/603 |
| 8,485,699 | B2 * | 7/2013 | Reda, Jr. | 362/401 |
| 8,650,697 | B2 * | 2/2014 | Lombardi | 15/167.1 |
| 2007/0039109 | A1 | 2/2007 | Nanda | |
| 2012/0047669 | A1 | 3/2012 | Pate | |

FOREIGN PATENT DOCUMENTS

| | | |
|---|---|---|
| WO | WO 99-17915 | 4/1999 |
| WO | PCT/US2013/064991 | 1/2014 |

OTHER PUBLICATIONS

Schematic/Photo of "NUK Bottle Brush—Flat Bottom" (see attached image).

Photo of Bottle Brush—Removable Base (see attached image).

* cited by examiner

*Primary Examiner* — Randall Chin

(74) *Attorney, Agent, or Firm* — Law Offices of Kamran Fattahi

(57) ABSTRACT

An apparatus configured as a scrub brush having an ergonomic handle. The body of the handle is designed to move an upper elongate portion of the scrub brush to a vertical position in a 'rocking' motion. To move the head of the scrub brush above the body, the 'rocker brush' includes a stabilizing weight positioned within a cavity formed in a rounded bottom of the handle. The weight in the rounded bottom causes the scrub brush to 'flip' upwards in a rocking motion when a user sets the scrub brush on a flat surface, such as a kitchen or bathroom countertop.

11 Claims, 12 Drawing Sheets

700

$$w_R \cdot x_R + (w_0 x_0 + \int_l w_i x_i) \geq 0$$

ROCKER BRUSH ASSEMBLY

CROSS-REFERENCE TO RELATED APPLICATION

This application claims the benefit of U.S. Provisional Application Ser. No. 61/713,877, filed Oct. 15, 2012, the content of which is hereby incorporated herein by reference.

BACKGROUND OF THE INVENTION

The present invention relates to the field of kitchen utensils. The present invention is more particularly directed to brushes and scrubbers with sponges for washing dishes or other household articles.

Currently, there exists a number of handheld brushes and scrubbers on the market that are used primarily for washing dishes or other household articles and items. These existing brushes and scrubbers typically include a handle for holding the unit and a sponge with or without an abrasive pad for scrubbing and washing dirty dishes.

A problem or shortcoming exists in the case of existing dishwashing brushes and scrubbers in that when the unit is not in use in the hands of the user, it has to be placed on a resting surface such as on a surface of the kitchen sink, on the kitchen counter or on some other substantially flat surface. In those instances, one problem is that the sponge, brush, or scrubbing surface of the unit typically comes in contact with the surface on which it rests, and that causes the other undesirable dirty surface that contains germs, bacteria, or other dirty particles to come into contact with and be passed onto the sponge, brush or scrubbing surface.

In view of the foregoing, there is a need for, and what was heretofore unavailable, a handheld brush, scrubber and/or sponge unit for use in washing dishes or other household objects is needed that is simple to use and that allows for placement of the unit at its base on a resting surface that can rock from side to side such that the unit can stand up on its own weight and avoid contact between the brush/scrubber/sponge portion and the resting surface, thereby preventing the passing of germs, bacteria or other dirty particles from between the resting surface and the brush/scrubber/sponge portion. The present invention fulfills these and other needs.

SUMMARY OF THE INVENTION

Briefly, and in general terms, the present invention is directed to a utensil used for cleaning. The utensil is referred to as a 'rocker brush' because it is designed to move to a vertical position when laid flat on a surface, such as a kitchen countertop.

The rocker brush is configured with an upper elongate portion having a scrubbing device attached to the upper portion. The scrubbing device may be manufactured as an arcuate brush, an elongate brush, a scouring pad or other desired configurations. The rocker brush further includes a handle attached to the upper elongate portion. The upper the elongate portion may be removably attached to the handle portion by threads or other mechanisms. A stabilizing weight is positioned within a rounded bottom portion of the handle.

The stabilizing weight has a mass configured to move the elongate portion from a horizontal position relative to the handle portion to a vertical position relative to the handle portion. The stabilizing weight is positioned in a rounded pocket within the bottom of the handle. The handle bottom further includes a flattened portion in longitudinal registration with a central axis of the stabilizing weight.

The rocker brush handle may be formed with one or more reinforcing struts positioned within the handle. The handle body may be manufactured so that the stabilizing weight is positioned within a bottom cavity formed by a bottom portion of the handle body and a reinforcing strut. The handle body may be formed as two halves and joined together by sonic welding (ultrasonic, high frequency vibrations), thermal welding, chemical boding and other suitable processes. The two halves of rocker brush may be formed vertically (left and right) or horizontally (top and bottom) with the stabilizing weight positioned in the bottom portion of the handle body.

Other features and advantages of the invention will become apparent from the following detailed description, taken in conjunction with the accompanying drawings, which illustrate, by way of example, the features of the invention.

DETAILED DESCRIPTION OF THE INVENTION

Figure 1:
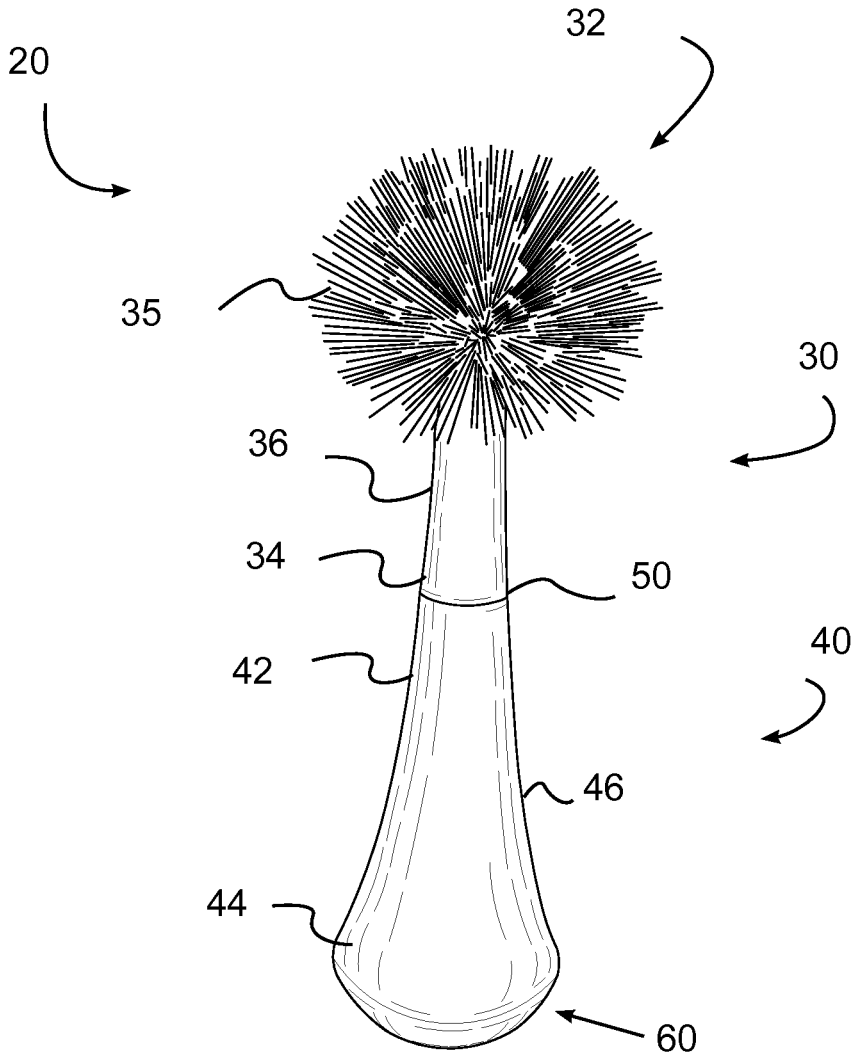
FIG. 1 is a front plan view of an embodiment a rocker brush of the present invention.

As shown in the drawings for purposes of illustration, the present invention is directed to a kitchen utensil. The present invention is further directed to a scrub brush having an ergonomic handle. The body of the handle is configured to move an upper elongate portion of the scrub brush when placed in a horizontal position to a vertical position in a 'rocking' motion. To move the head of the scrub brush above the body, the 'rocker brush' includes a stabilizing weight positioned within a cavity in a rounded lower portion (bottom) of the body that is used as a handle. The weight in the rounded bottom causes the scrub brush to 'flip' upwards in a rocking motion when a user sets the scrub brush on a flat surface, such as a kitchen or bathroom countertop.

Figure 2:
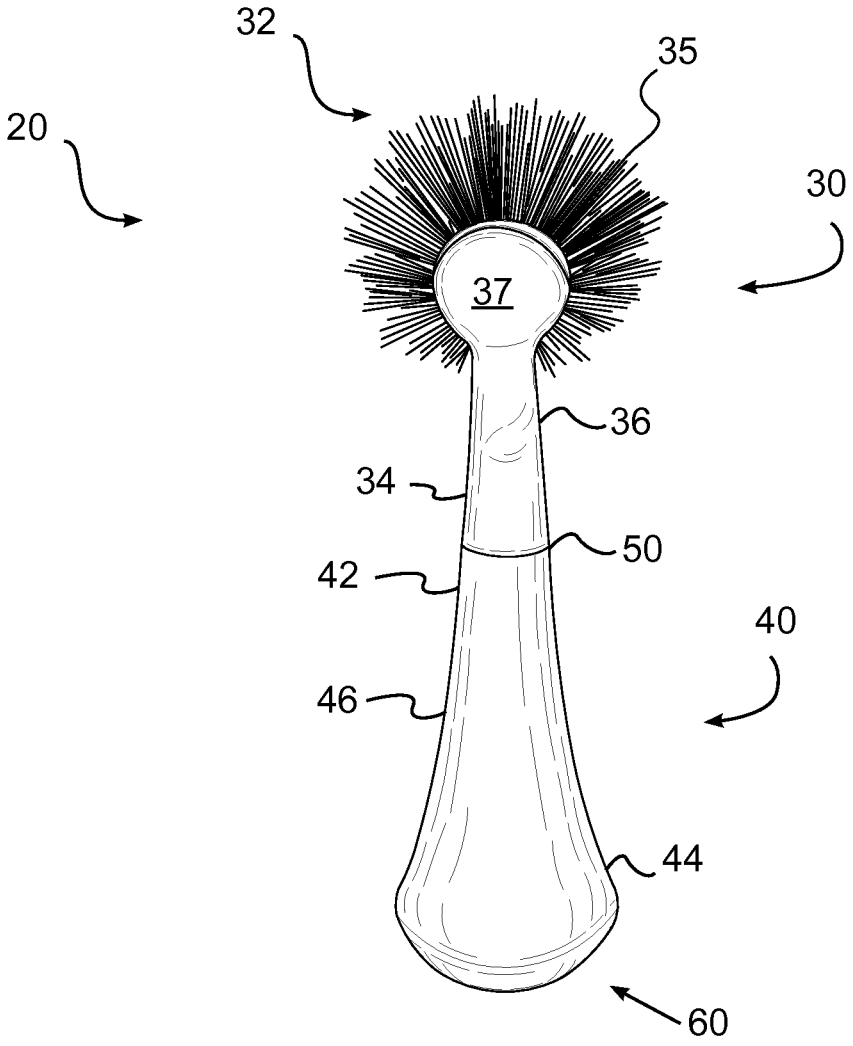
FIG. 2 is a rear plan view of an embodiment a rocker brush of the present invention.
Figure 3:
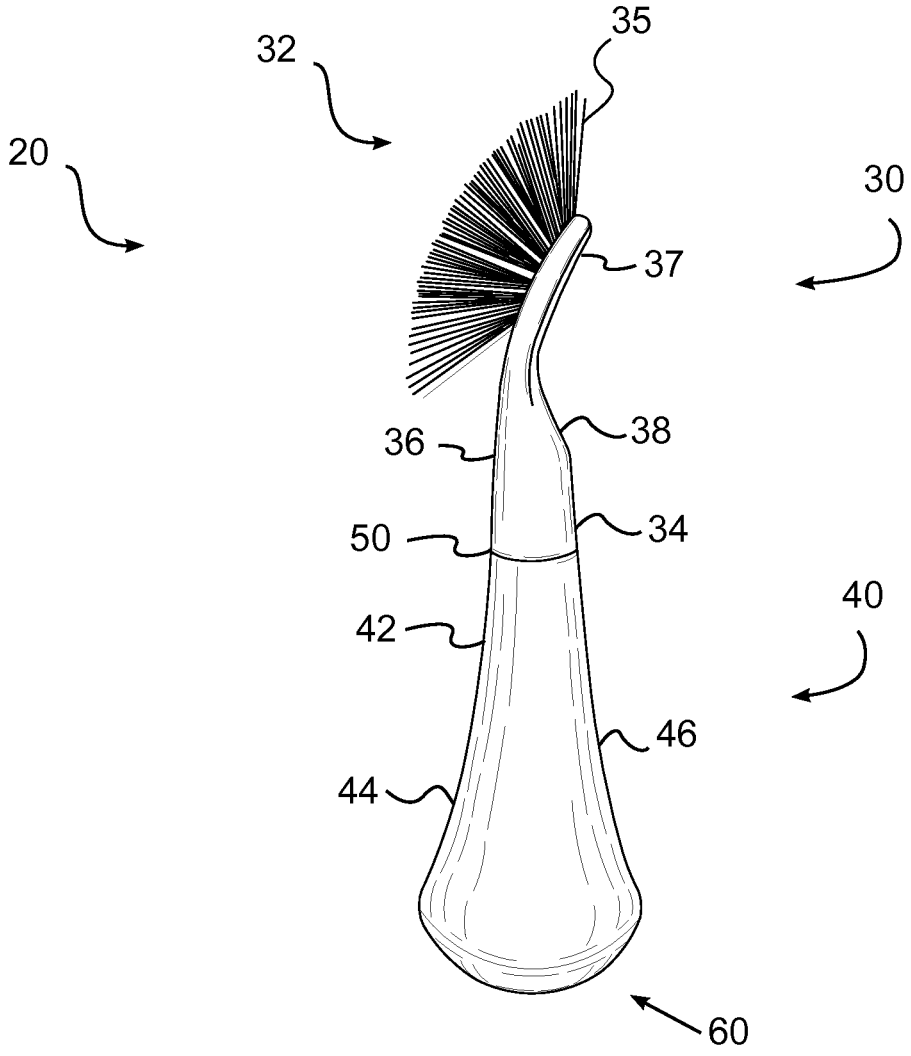
FIG. 3 is a side plan view of an embodiment a rocker brush of the present invention.

Turning now to the drawings, in which like reference numerals represent like or corresponding aspects of the drawings, and with particular reference to FIGS. 1-3 a rocker brush 20 of the present invention is shown having an elongate (upper) portion 30, and a body (handle) portion 40, which is formed with a rounded bottom portion 60. Although the rocker brush may be held or positioned at any angle, the terms "top", middle" and "bottom" are in reference to the rocker brush when it is resting upright on a flat surface.

Referring again to FIGS. 1-3, the rocker brush 20 is formed with an upper portion 30 having a top portion 32, a bottom portion 34 and a middle portion 36. The top, middle and bottom portions of the upper elongate portion may have any suitable shape for enhancing a scrubbing action of the rocker brush. For example, a scrub brush 35 may be attached to a relatively flat surface 37 (see FIGS. 2 and 3) of the top portion of the rocker brush. A transition section 38 may be tapered or otherwise suitably shaped to efficiently impart force from the body (handle) portion 40 to the scrub brush. The bottom section 34 of the elongate portion of the rocker brush may be generally cylindrical, and may taper to a larger diameter from the transition section so as to have substantially the same diameter as the upper portion 42 of the handle.

Figure 6:
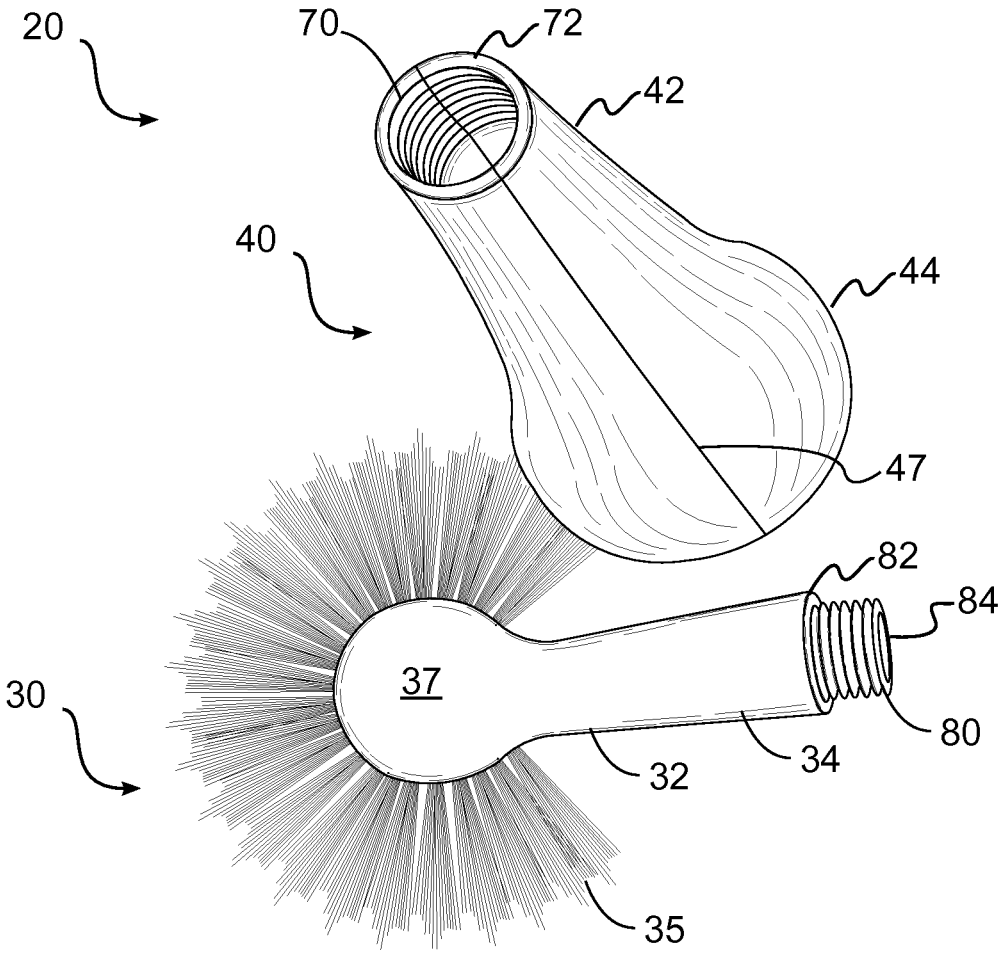
FIG. 6 is a top perspective view of an embodiment the rocker brush in accordance with the present invention, wherein the top portion is disconnected from the bottom portion.

As shown in FIGS. 1-3, the upper section 30 may be configured to detach from the body (handle) portion 40 (see FIG. 6). To provide continuity and force from the handle to the scrub brush 35, the bottom portion 34 of the upper section may be configured with about the same diameter as the upper portion 42 of the handle. As is known to one of ordinary skill in the art of making kitchen or similar utensils, a substantially watertight seal may be formed at the juncture 50 of the two portions of the rocker brush. Alternatively, the elongate upper portion 30 and body (handle) portion 40 may be formed as one part. The upper portion 30 and body (handle) portion 40 of the rocker brush may be manufactured using casting techniques, injection molding, sonic welding, bonding with glue or other adhesives and any other techniques now known or available in the future to those of ordinary skill in the art.

Referring again to FIGS. 1-3, one embodiment of the body (handle) portion 40 of the rocker brush 20 is formed with a body that creates an ergonomic handle. The upper portion 42 of the body is generally cylindrical and tapered to provide a smooth juncture 50 against the bottom portion 34 of the elongate portion 30 of the rocker brush. The diameter of the upper portion of the handle body is designed so that rocker brush can be easily grasped by the fingers of a user. In particular, the index and/or middle finger of the hand can be used to impart a strong force on the top portion 32 of the elongate portion and thereby onto the scrub brush 35. Similarly, the fingers may be used to easily and vigorously move the scrub brush in various cleaning motions, for example, up/down and side-to-side. The middle portion 46 of the handle body is again generally cylindrical, but is wider than the upper portion of the body so that the handle fits snugly (conforms) to the palm of the user's hand. For even a stronger grip, the cylindrical handle bottom portion 44 may be wider than the middle portion to provide a firm grip for the user. As shown for references purpose only, and is not intended to be limiting, the rocker brush body has a gradual and arcuate (partial circle) taper from the top to the bottom of the handle.

Figure 4:
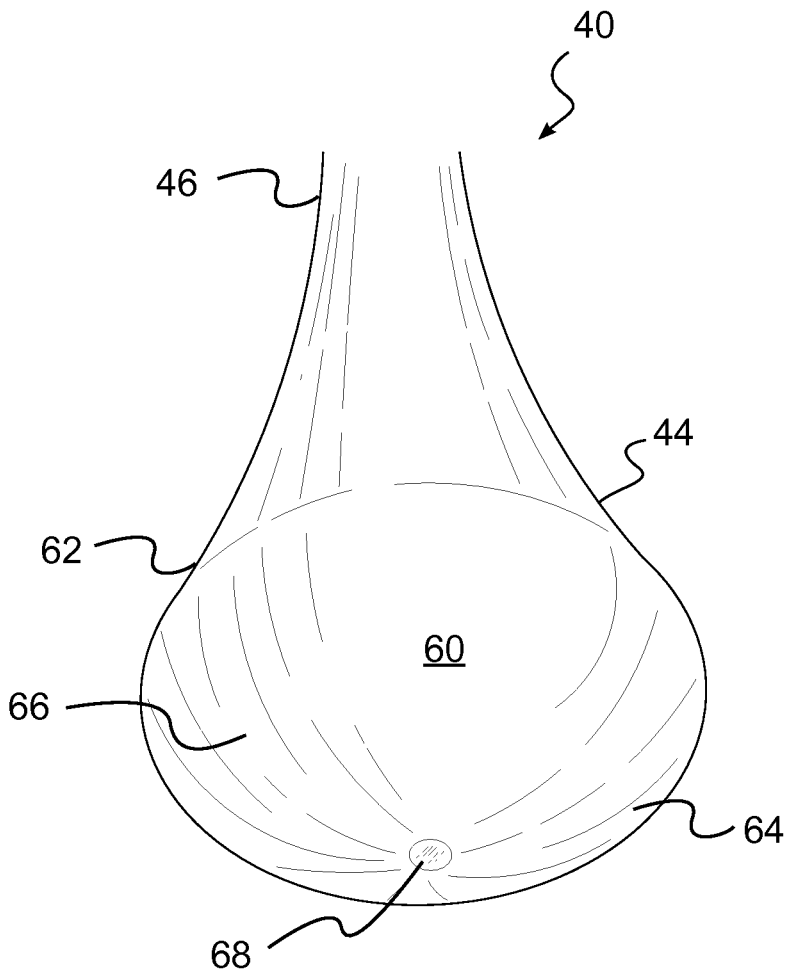
FIG. 4 is bottom perspective view of an embodiment a rocker brush of the present invention.
Figure 5:
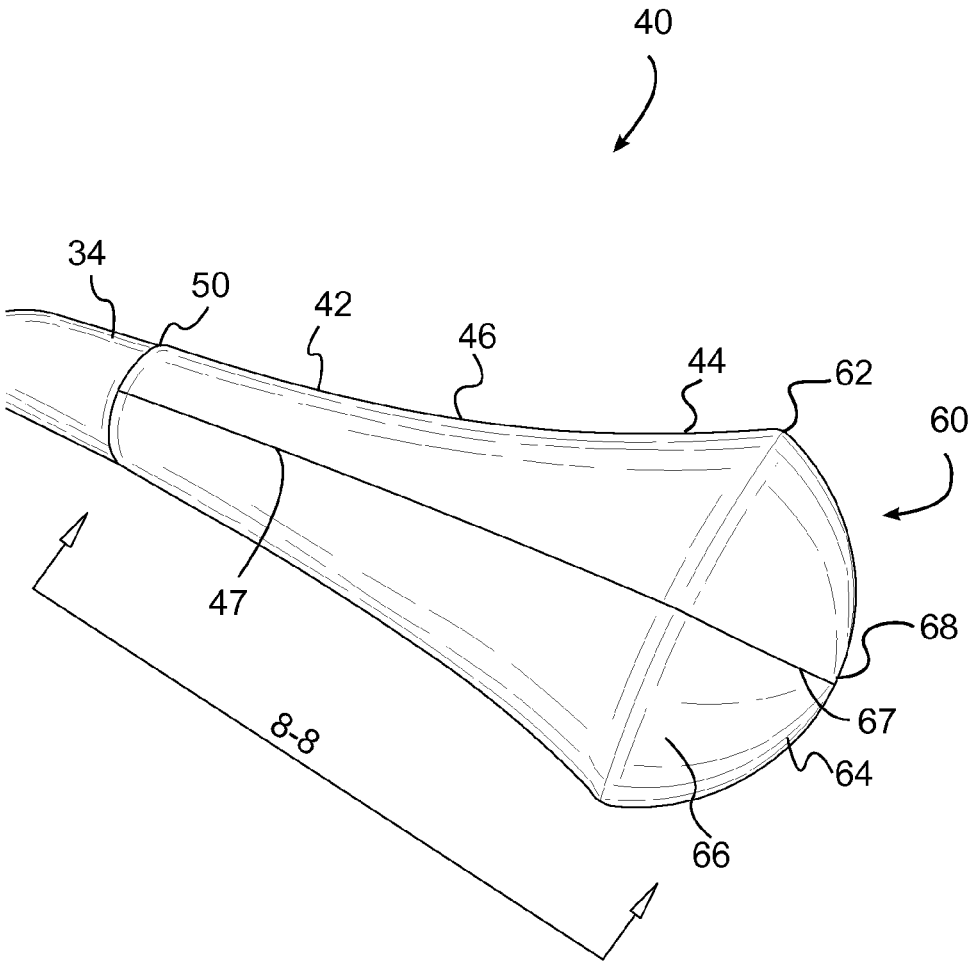
FIG. 5 is a side perspective view of an embodiment a rocker brush of the present invention.

As shown in FIGS. 4 and 5, the body (handle) portion 40 of the rocker brush is configured with a cylindrical and tapered rounded bottom portion 60. The tapered bottom starts at top edge 62 contiguous with the bottom portion 44 of the body (handle) portion 40. The lower portion 64 of the bottom of the body (handle) portion 40 is flatter (less steep) than the middle portion 66 of the handle bottom. In one embodiment of the handle bottom portion, the very bottom 68 (point farthest from the scrub brush 35) is flattened so that the rocker brush rests upright when the elongate portion 30 and scrub brush are vertically above the handle (see FIGS. 1-3, 7A and 7B). Without undue experimentation, the length, diameter and curvature of the body (handle) portion 40 and the bottom portion of the body (handle) portion 40 may be configured for stability (movement from a substantially horizontal position to a vertical position) and for increasing the look, feel and utility of the body (handle) portion 40.

Referring now to FIG. 6, one embodiment of the rocker brush 20 is configured so that the upper elongate portion 30 having the scrub brush 35 is detachable from the body (handle) portion 40 that forms the handle of the apparatus. The upper portion 42 of the body (handle) portion 40 includes a set of threads 70 that begins at the utmost top 72 of the body (handle) portion 40 and extends downward within a cylindrical cavity in the body (handle) portion 40. The end 74 of the threads 70 (see FIG. 8) may be configured within the upper portion of the body (handle) portion 40 so as to allow the body (handle) portion 40 to curve outward toward its bottom portion 44.

As shown in FIG. 6, the elongate upper portion 30 of the rocker brush 20 may include a set of threads 80 starting proximate the end 82 of the bottom portion 34 of the scrubber. The threads extend a sufficient length from the elongate portion so as to have an end point 84 that provides a set of threads substantially the same length as the set of threads 70 in the body (handle) portion 40. The length of threads in the scrub brush portion may be shorter than the length of threads in the body so long as the upper and bottom portions of the rocker brush are firmly secured. Likewise, the upper and bottom portions should be joined to provide an essentially watertight seal at the juncture 50 of the two portions of the rocker brush (see FIGS. 1-3, 7A and 7B). Alternatively, the upper and bottom portions of the rocker brush may be secured by other mechanisms known to those of ordinary skill in the art, such as a press fit, snap locks, pin and slot devices, and bonding materials.

Figure 7A:
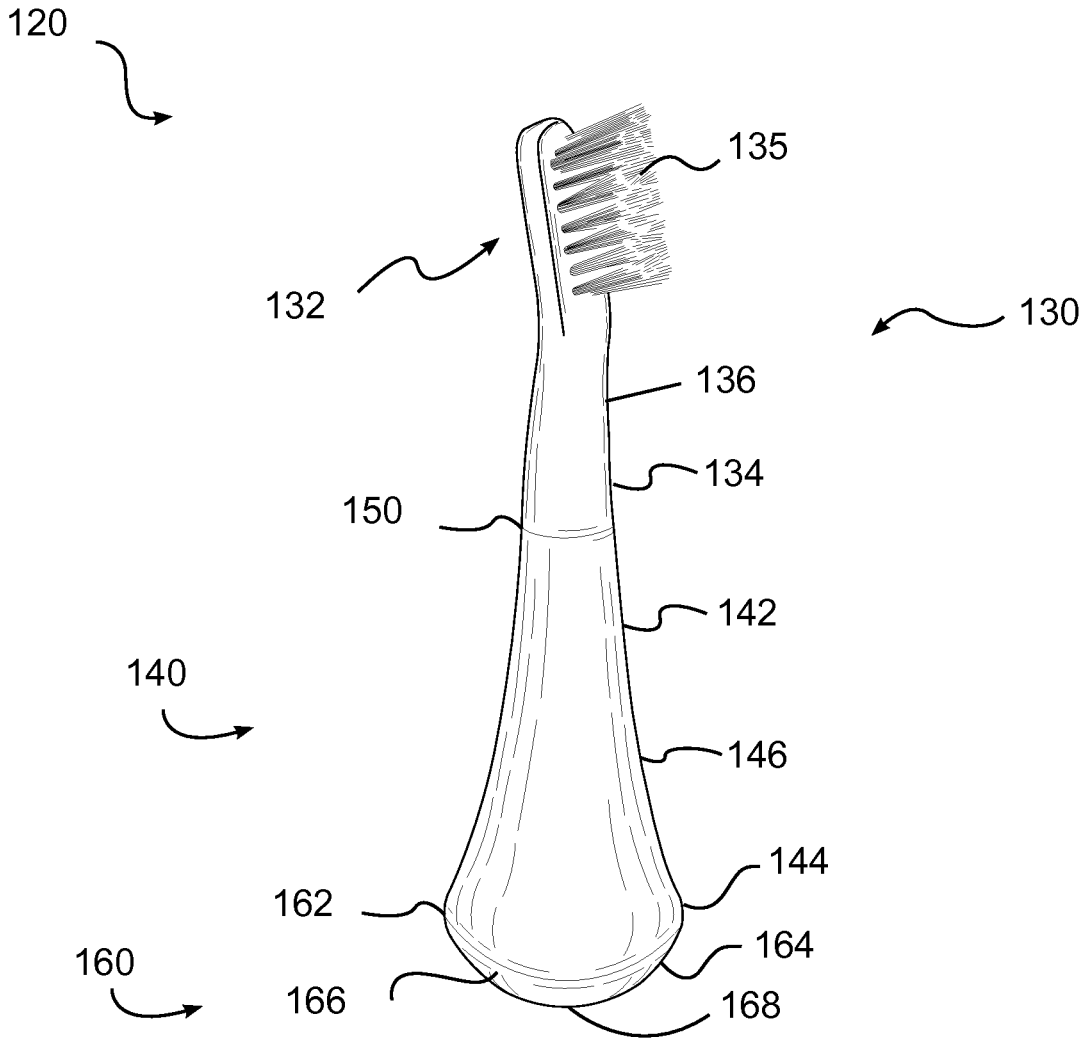
FIG. 7A is a side plan view of an alternative embodiment a rocker brush of the present invention.
Figure 7B:
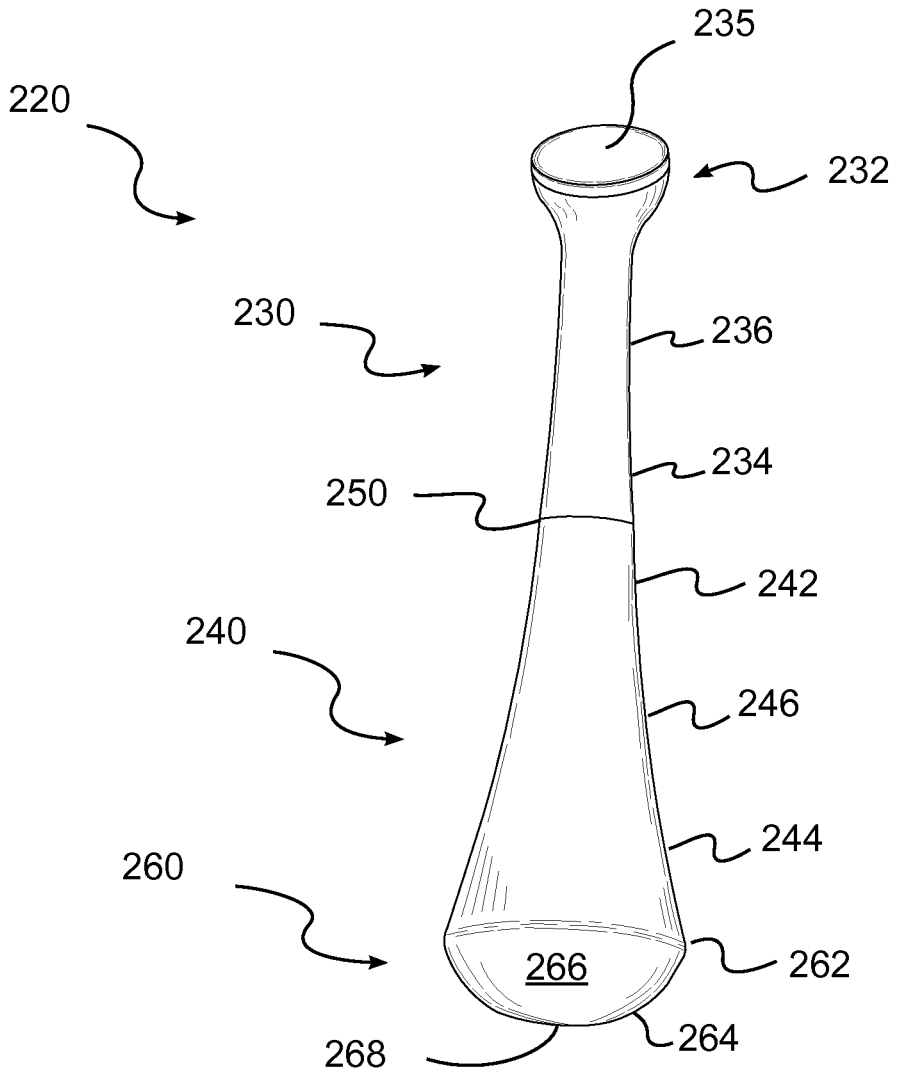
FIG. 7B is a side plan view of an alternative embodiment a rocker brush of the present invention.

Alternative embodiments of the circular scrub brush 35 shown in FIGS. 1-3 and 6 secured to the elongate upper portion 30 of the rocker brush are contemplated in accordance with the present invention. For example, as shown in FIG. 7A, a rectangular head 135 is attached to the top end 132 of the upper portion 130 of the rocker brush 120. In FIG. 7B, a circular or oval head 235 is attached to the top end 232 of the upper portion 230 of the rocker brush 220. The length of the end portions (134, 234) and middle portions (136, 236) of the scrubbing portion may be configured to provide appropriate leverage to the brush or pad. For example, the overall length may be shorter to impart more force to a grout brush and longer for a scouring pad used on deep pots and pans. Similarly, the body (140, 240) may have longer or shorter top (142, 242), middle (146, 246) and bottom (144, 244) portions. In addition the rocker portion 160, 260 may have a wider or narrower upper (162, 262), middle (166, 266) and bottom (164, 264) portions. Furthermore, the resting pad 168, 268 may be larger or smaller in diameter to accommodate the dimensions of the overall rocker brush configuration.

The scrub brush heads may be made of any suitable material for the desired function of the rocker brush. For example, polymers, plastics, rubber, metals and composite materials may be used. More specifically, polypropylene, polycarbonates, polyurethanes, acrylics, vinyls, Nylon, poly-methyl mythacrylate (PMMA), acrylonitrile butadiene styrene (ABS), methylmethacrylate-styrene (MS) and polyethylene terephthalate (PET) are known materials that can may be used by one of ordinary skill in the art to form the brush material. In addition, a particular brush design may be made of more than one material. As contemplated within the scope of the present invention the circular brush shown in FIG. 1 may be formed with harder (stiffer) bristles in the middle than on the outside. Similarly, the grout type brush shown in FIG. 7A may include softer, longer bristles in the center, stiffer bristles in the middle and a third type of bristle on the edges. The bristles and pads may be colored to indicate the abrasiveness or strength of the materials used in the scrub brush.

The SCOTCH-BRITE synthetic scouring pad material available from 3M of St. Paul, Minn. (spun polypropylene fibers containing aluminum oxide) may especially useful for attaching to the circular or oval head 235 depicted the design shown in FIG. 7B. Alternatively, a soft sponge material may be attached to the circular or oval head 235. The circular or oval head 235 may be configured so that the scrubbing device is removably attached to circular or oval head 235.

The rocker brush body (handle) portion 40 may also be formed of any suitable materials depending upon the function of the apparatus. The materials listed herein regarding the bristle brushes may also be engineered by one of ordinary skill in the art without undue experimentation to form the rocker brush handle. For example, moldable and extrusion plastics, thermoplastics, rubber, metals, wood and composites may be used to form the handle. Thermoplastics (for example Nylon and polypropylene) are known materials that can be used to form two handle body halves configured to be joined using sonic or thermal (heat) welding.

Figure 8:
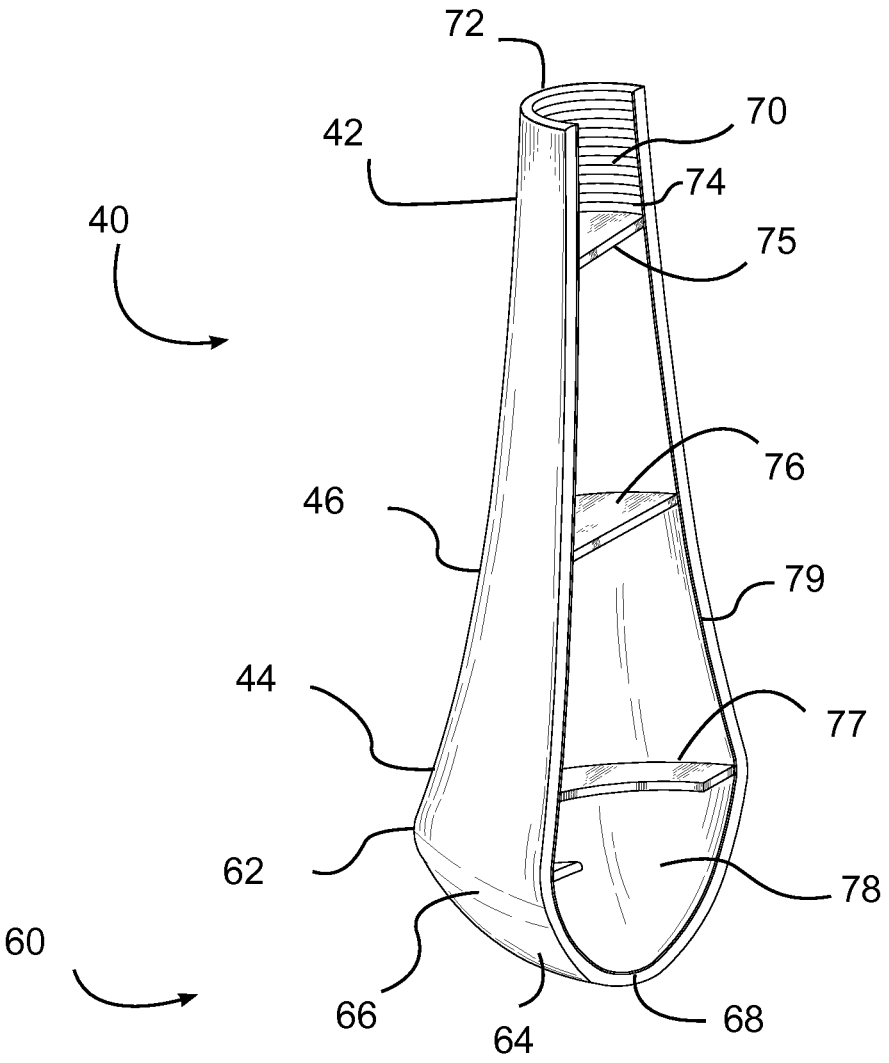
FIG. 8 is a side perspective view in partial cross-section of a body of a rocker brush in accordance with the present invention taken along line 8-8 of FIG. 5.

Referring now to FIG. 8, one embodiment of the body (handle) portion 40 of the rocker brush is manufactured from a two-part shell that is joined to form a single handle having a circumferential seam 47, 67 (see FIGS. 5 and 6). Each half of the shell includes a top portion, including threads 70 that begin at an upper edge 72 of the shell. In an embodiment of the present invention, each half of the body (handle) portion 40 includes a first reinforcing strut 75 positioned in the top section of the body just below the ending point 74 of the threads. Each reinforcing strut 75 may be configured with an overlapping flange to avoid fluid leakage into the top portion 42 of the body (handle) portion 40 from the juncture 50 with the upper elongate portion 30.

A second reinforcing strut 76 is positioned in the middle portion 46 of each half of the body (handle) portion 40. Each half of both the top reinforcing struts 75 and middle reinforcing struts 76 are semicircular in shape so that the two halves form a flat circular disk when the two halves of the body (handle) portion 40 are joined together. These struts give the body (handle) portion 40 'hoop strength' to prevent the body (handle) portion 40 from collapsing when grasped by the user. The top reinforcing struts also provide longitudinal strength and help distribute the scrubbing force when the handle is joined to the elongate portion 30 having the scrub brush head 35 (FIGS. 1-3).

Referring again to FIG. 8, the rounded bottom portion 60 of the body (handle) portion 40 includes a third reinforcing strut 77 in the lower portion 44 of the body (handle) portion 40 and at the top edge 62 of the rounded bottom portion. Each half of the third reinforcing strut is "C" shaped—semicircular with a central semicircular cutout. Thus, when the two halves of the third reinforcing strut are joined they form an "O" shaped disk (toroidal, or 'doughnut' shape). The combined halves of the third reinforcing strut and the wall of the middle portion 66 of the rounded bottom portion of the body form a cavity 78 for retaining a stabilizing weight (see FIG. 9). The two halves of rocker brush may be formed vertically (left and right) or horizontally (top and bottom) with the stabilizing weight positioned in the bottom portion of the body (handle) portion 40.

Figure 9:
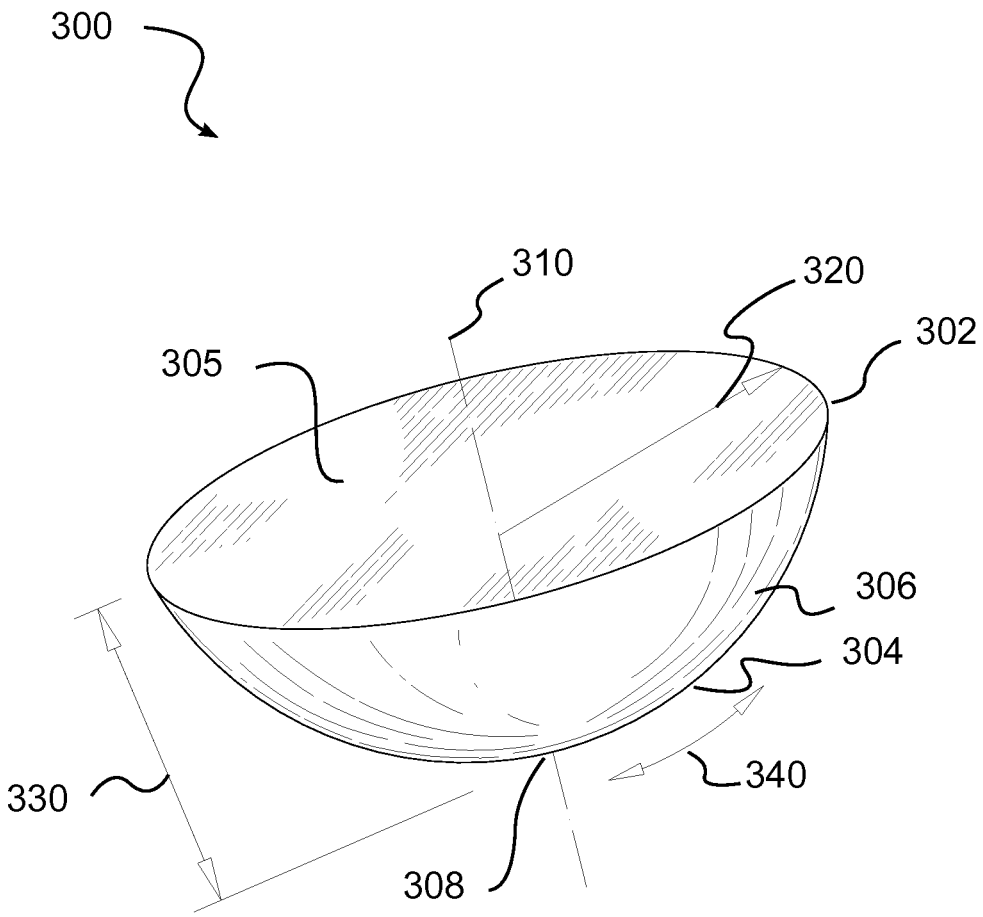
FIG. 9 is a perspective view of a stabilizing weight of the present invention.

As shown in FIG. 9, the stabilizing weight 300 is provided to give weight to the bottom portion of the handle body of the rocker brush. The stabilizing weight need not have any particular shape, but should conform to the design of the rocker brush handle. For example, to properly fit within the cavity 78 of the rounded bottom portion 60 of the body (handle) portion 40 shown in FIG. 8, the stabilizing weight is formed with a flat upper surface 305 and rounded outer sides 306 that are positioned against the middle portion 66 of the handle bottom. The top portion 302 of the stabilizing weight is positioned adjacent the top edge 62 of the rounded handle bottom. The bottom portion 304 of the stabilizing weight is positioned adjacent the arcuate wall 64 of the handle bottom, so that the ultimate bottom 308 of the stabilizing weight rests against the flat portion 68 of the handle bottom that provides a platform for the rocker brush when standing vertical.

A centerline 310 of the stabilizing weight 300 is shown FIG. 9. The radius 320 of the upper surface 305 is chosen to accommodate the internal diameter of the cavity 78 at the top edge 62 of the rounded bottom portion 60 of the rocker brush body (handle) portion 40 (see FIGS. 4, 5 and 8). The height 330 of the stabilizing weight is chosen to fit between the third reinforcing strut 77 (if provided as shown in FIG. 8) and/or the top edge 62 of the rounded bottom portion of the rocker brush handle. The curvature 340 of the stabilizing weight is chosen to coincide with the curvature of the middle portion 66 of the rocker brush handle.

Figure 10:
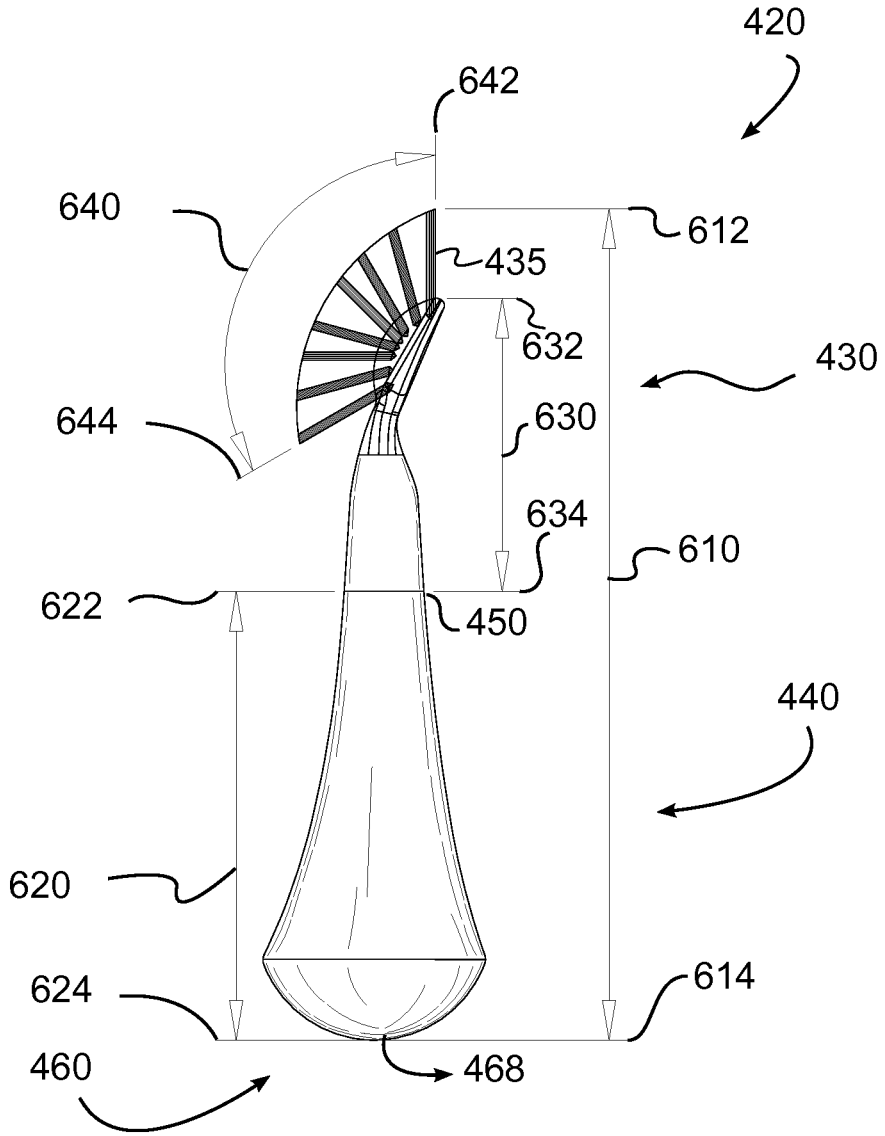
FIG. 10 is a side plan view of a rocker brush of the present invention depicting component dimensions.
Figures 11A, 11B:
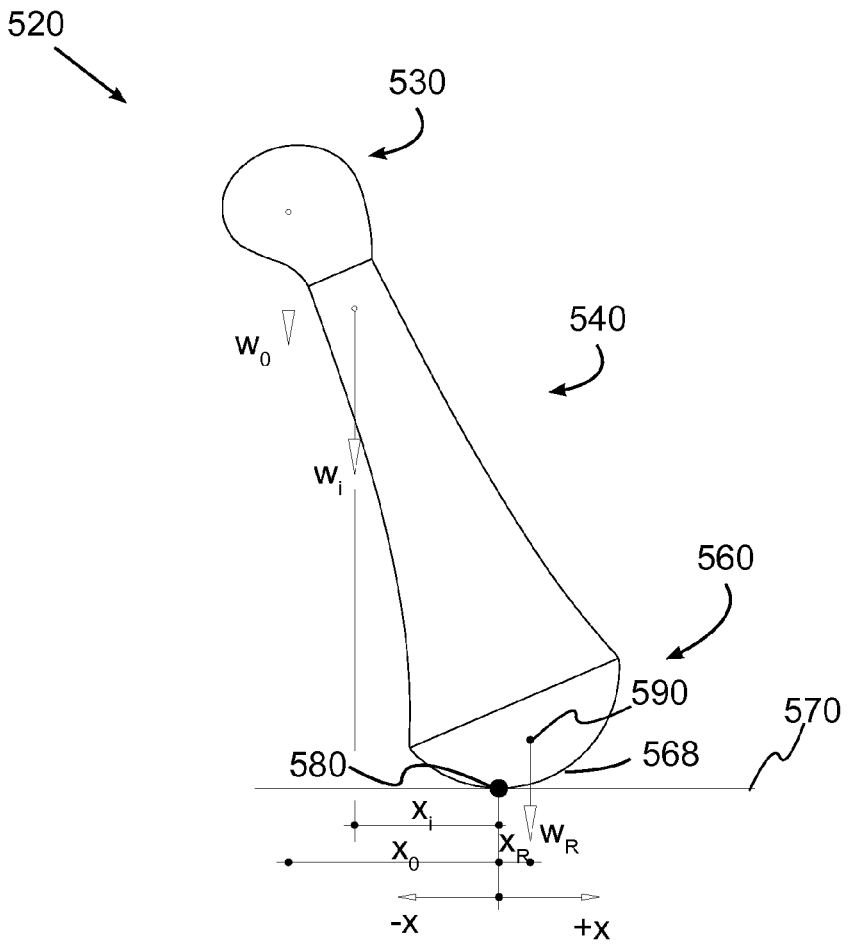
FIG. 11A is a schematic representation of a rocker brush of the present invention depicting component dimensions and weight vectors.
FIG. 11B is an equation for calculating the mass of a stabilizing weight in accordance with the present invention using the component dimensions shown in FIG. 11A.

For a rocker brush designed for use in an adult human hand and formed from a thermoplastic (for example, Nylon or polypropylene), having the height dimensions shown in FIG. 10 and using the calculations shown in FIGS. 11A and 11B, the diameter of the stabilizing weight 300 is about fifty (50) millimeters and the height 330 of the stabilizing weight is about eighteen (specifically 18.2) millimeters. Using the dimensions from FIGS. 10, 11A and 11B, the calculated 'mass' of the stabilizing weight is one hundred and sixty-five (165) grams. The dimensions recited herein can be adjusted without undue experimentation by one of ordinary skill in the art using the schematic and calculations shown in FIGS. 11A and 11B.

The stabilizing weight may be made from suitable metals (for example, stainless steel, tin and iron), high-density plastics and composite materials (for example, plastic or rubber embedded with metal shot) that are applicable for kitchen utensils. Stainless steel is particularly useful for its anti-corrosion (oxidation resistant) properties when the rocker brush is used with water, detergents and corrosive solvents. The stabilizing weight may be formed as a solid body or an empty shell, so long as the weight and center of gravity conditions set forth in FIGS. 11A and 11B are satisfied.

Referring now to FIG. 10, one embodiment of the rocker brush 420 is configured with ergonomic dimensions for use in an adult human hand. The height 610 of the combined upper elongate portion 430 and handle body 440 is about two hundred and eight (specifically, 208.83) millimeters, when measured from the top 612 of the arcuate scrub brush 435 to the lowest end 614 of the rocker brush at the flat resting section 468 of the handle bottom portion 460. The height 620 of the body handle is about one hundred and ten (specifically, 112.8) millimeters, when measured from its top 622 at the juncture 450 with the upper elongate portion down to its lowest end 624 at the flat resting section of the handle bottom portion. The height 630 of the upper elongate portion is about eighty-eight (specifically, 88.74) millimeters, when measured from its uppermost tip 632 down to its lowest point 634 at the juncture with the handle body. The arc (angle) 640 of the depicted scrub brush is about one hundred and twenty degrees, when measured from the uppermost bristle 642 to the bottom bristle 644. The disclosed dimensions are by example only, and are not intended to be limiting, since other dimensions may be applicable for other rocker brushes, see FIGS. 7A and 7B.

FIGS. 11A and 11B provide a schematic of the rocker brush 520 and formula for calculation of the weight needed in the bottom portion 560 to counterbalance the combined weight of the upper portion 530 and the body portion 540. More specifically, the calculation of the stabilizing weight (see FIG. 9) is determined to effect the intended function of the having the rocker brush move from a substantially horizontal position (for example, thirty degrees) at the resting point 580 on a surface 570 (for example, a countertop) to a vertical position so that the rocker brush then rests (rocks back-and-forth) on the flat bottom portion 568.

In the schematic of FIG. 11A, the horizontal distance that the upper portion 530 of the rocker brush 520 moves is depicted by an arrowed line (−X to +X). The distance from where the bottom portion 560 of the handle body 540 is touching the surface 570 is shown as a resting point 580, which is the reference point for calculating the horizontal distances (X0, Xi) for each weight vector (W0, Wi). For purposes of calculating the bottom weight vector "WR" of the bottom portion 560 (including the stabilizing weight) at the center of gravity 590 of the rocker brush, the upper portion is given a single upper weight vector "W0" and a single upper distance "X0" from the resting point. The handle body, however, is assigned a plurality of body weight vectors "Wi", each having a body distance "Xi". Alternatively, the upper body also could be assigned a plurality of weight vectors and horizontal distances from the resting point.

The mass of the bottom portion 560 (substantially from the stabilizing weight—see FIG. 9) is calculated using the formula 700 in FIG. 11B. The calculation includes a summation (sigma ∫) of a selected number of bodyweight vectors from "Wi" to "W|" multiplied by the distance "Xi" to "X|" of that weight vector from the resting point 580. The summation of the products of the body weight vectors and distances is added to the product of the single upper weight vector "W0" multiplied by the single upper distance "X0". According to the calculation, the product of the bottom center of gravity weight vector "WR" multiplied by the distance "XR" from the resting point must be greater than the sum of the upper weight vector-distance product and the summation of each body weight vector-distance product. Calculating, measuring and/or estimating the center of gravity of the rocker brush, each weight vector and each distance of the weight vector from the resting point provides the basis for calculating the needed mass of the stabilizing weight.

Those skilled in the art of manufacturing mechanical devices such as the disclosed kitchen utensil can determine, without undue experimentation, the appropriate dimensions, geometries, materials, and other features of the upper elongate portion and scrub brush. Similarly, those skilled in the art can determine, without undue experimentation, the appropriate dimensions, geometries, materials and other features of the handle body of the device. Other embodiments in accordance with the present invention (for example, but not limited to, alternative scrubbing devices and stabilizing weights) may be employed as is known to those skilled in the art of designing and/or manufacturing of kitchen utensils. Similarly, those skilled in the art will understand from the disclosure herein that various modifications to the components of the rocker brush can be made without departing from the scope of the invention. More specifically, the present invention is not limited to any particular method of forming the elongate upper portion and the handle body of the rocker brush.

While certain aspects of the invention have been illustrated and described herein in terms of its use as a 'scrub brush' or 'rocker brush', modifications and improvements to the disclosed apparatus may be made without departing from the scope of the invention. Accordingly, the scope of the invention is not intended to be limited by, for example, but not limited to, the details of the drawings and the appended claims.

I claim:

1. An apparatus, comprising:

an elongated upper portion;

a single piece body handle portion that has a rounded bottom portion;

the elongated upper portion, includes:

a progressively increasing elongated upper portion diameter from a top portion of the elongated upper portion to a bottom portion of the elongated upper portion;

the top portion of the elongated upper portion integrally includes a tool;

the bottom portion of the elongated upper portion is comprised of:

a male threading that extends longitudinally along a longitudinal axis of the elongated upper portion from a distal end of the bottom portion and has an outer diameter that is smaller than a bottom portion outer diameter of the elongated upper portion, with a difference between male threading outer diameter and the bottom portion outer diameter of the elongated upper portion defining a first contact surface of a connecting junction of the elongated upper portion at the distal end of the bottom portion of the handle body portion;

the body handle portion with the rounded bottom portion is comprised of:

a progressively increasing body handle portion diameter from an upper portion of the body handle portion to a top edge of the rounded bottom portion, with the rounded bottom portion diameter progressively decreasing from the top edge to form a spheroid rounded bottom portion;

a section of the upper portion of the body handle portion has a female threading that extends longitudinally along a central longitudinal axis of the body handle portion with rounded bottom portion from a top of the body handle portion that defines a second contact surface of the connecting junction, with female threading having an ending point near a lower end of the upper portion of the body handle portion;

the elongated upper portion is detachably connected to the body handle portion by fastening the respective male and female threading, with respective first contact surface and the second contact surface defining the connecting junction of the elongated upper portion and the body handle portion when fully assembled;

a first reinforcing strut in a form of a first disc that is positioned within the upper portion of the body handle portion, adjacent but below the ending point of the female threading;

the first reinforcing strut is oriented transverse the central longitudinal axis of the body handle portion with the rounded bottom portion, with a plane of the first reinforcing strut perpendicular the central longitudinal axis of the body handle portion with the rounded bottom portion;

a second reinforcing strut in a form of a second disc is positioned within a middle portion of the body handle portion, below the first reinforcing strut and above the top edge of the rounded bottom portion;

the second reinforcing strut is oriented transverse the central longitudinal axis of the body handle portion with the rounded bottom portion, with a plane of the second reinforcing strut perpendicular the central longitudinal axis of the body handle portion with the rounded bottom portion;

the rounded bottom portion includes a third reinforcing strut in a form of an annular disc below a lower portion of the handle body portion and at the top edge of the rounded bottom portion;

the third reinforcing strut is oriented transverse the central longitudinal axis of the body handle portion with the rounded bottom portion, with a plane of the third reinforcing strut perpendicular the central longitudinal axis of the body handle portion with the rounded bottom portion;

the first, the second, and the third reinforcing strut have respective first, second, and third centers that are aligned with the central longitudinal axis of the body handle portion with the rounded bottom portion;

the first, the second, and the third reinforcing strut have a respective first diameter, second diameter, and a third diameter, with first diameter having a span that is shorter than the second diameter and the third diameter, and the second diameter that is shorter than the third diameter;

the rounded bottom portion further includes a cavity within which a stabilizing weight having a central axis is housed and further, secured in position by the third reinforcing strut, with a flattened portion of the rounded bottom portion in longitudinal registration with the central axis of the stabilizing weight.

2. The apparatus of claim 1, wherein the stabilizing weight has a mass configured to move the elongate upper portion from a horizontal position relative to the body handle portion to a vertical position relative to the body handle portion.

3. The apparatus of claim 2, wherein the handle portion forms a rounded pocket for retaining the stabilizing weight.

4. The apparatus of claim 1, wherein the tool is a scrubbing device, which is an arcuate brush.

5. The apparatus of claim 1, wherein the tool is a scrubbing device, which is an elongate brush.

6. The apparatus of claim 1, wherein the tool is a scrubbing device, which is a scouring pad.

7. The apparatus of claim 1, wherein the first end of the elongate portion is configured to accommodate a removable scrubbing device.

8. The apparatus as set forth in claim 1, wherein:

the body handle portion with the rounded bottom portion is further comprised of:

a first shell and a second shell that are joined at a circumferential seam to form a single body handle portion with the rounded bottom portion.

9. The apparatus as set forth in claim 8, wherein:

the first shell and the second shell include respectively:

a first semicircular disc and a second semicircular disc, which form the first disc with the first diameter;

wherein: the first semicircular disc is connected to the first shell and the second semicircular disc is connected to the second shell.

10. The apparatus as set forth in claim 9, wherein:

the first shell and the second shell include respectively:

a third semicircular disc and a fourth semicircular disc, which form the second disc with the second diameter that is larger than the first diameter of the first disc;

the third semicircular disc is connected to the first shell and the fourth semicircular disc is connected to the second shell.

11. The apparatus as set forth in claim 10, wherein:

the first shell and the second shell include respectively:

a first semi-annular disc and a second semi-annular disc, which form the annular disc with an outer diameter that defines the third diameter that has a longer span than the second diameter of the second disc;

the first semi-annular disc is connected to the first shell and the second semi-annular disc is connected to the second shell.

* * * * *